US005249328A

United States Patent [19]

Shin

[11] Patent Number: 5,249,328

[45] Date of Patent: Oct. 5, 1993

[54] VACUUM CLEANER BEATER BRUSH STRUCTURE

[75] Inventor: Gug J. Shin, Kyungsangnam, Rep. of Korea

[73] Assignee: Goldstar Co., Ltd., Seoul, Rep. of Korea

[21] Appl. No.: 750,417

[22] Filed: Aug. 27, 1991

[30] Foreign Application Priority Data

Aug. 31, 1990 [KR] Rep. of Korea ..... 13721/1990

[51] Int. Cl.[5] ..... A47L 5/30

[52] U.S. Cl. ..... 15/182; 15/5; 15/183; 15/366; 15/376; 15/392

[58] Field of Search ..... 15/179, 182, 183, 366, 15/370, 372, 5, 376, 392

[56] References Cited

U.S. PATENT DOCUMENTS

| | | | |
|---|---|---|---|
| 1,349,765 | 8/1920 | Hoover | 16/376 |
| 1,829,548 | 10/1931 | Smellie et al. | 15/5 |
| 1,888,339 | 11/1932 | White | 15/376 |
| 3,225,374 | 12/1965 | Daley et al. | 15/183 |
| 3,737,937 | 6/1973 | Nordeen | 15/5 X |
| 3,802,026 | 4/1974 | Crener | 15/392 X |
| 4,209,872 | 7/1980 | Maier | 15/179 |
| 4,429,430 | 2/1984 | Lyman | 15/182 |

*Primary Examiner*—Chris K. Moore

*Attorney, Agent, or Firm*—Brumbaugh, Graves, Donohue & Raymond

[57] ABSTRACT

In a vacuum cleaner beater brush structure, a beater brush roller is provided with a helical brush strip and a beater strip. A sprocket comprises a support flange and a gear pulley, the gear pulley comprising a carrier having brush tufts and beater bars, a step, a toothed array for engaging with the timing belt, the circular rib for preventing inflow of air containing dirt toward rotating portions of the structure, and an axle for supporting rotation of the structure and integrally formed therewith. A support pulley comprises a circular rib for preventing inflow of air containing dirt toward the rotating portion and an axle adapted for supporting rotation of the structure and integrally formed therewith. A pair of bearing mounts are coupled with the pulleys. The bearing mount comprises a rectangular supporter, a bearing housing portion for receiving an oil-filled sleeve bearing adapted to rotatably support the axle, and openings for allowing air containing dirt to flow therethrough. The present invention provides a vacuum cleaner beater brush structure which is protected against damage of the rotating parts due to overheating, in which the rotating parts rotate smoothly and in which the noise and vibration are reduced.

3 Claims, 4 Drawing Sheets

VACUUM CLEANER BEATER BRUSH STRUCTURE

BACKGROUND OF THE INVENTION

The present invention relates to a vacuum cleaner structure, and more particularly to a beater brush structure for use in the vacuum cleaner capable of preventing a damage of the rotating parts thereof such as due to overheat, dust and the like, and also reducing noise and vibration thereof, efficiently.

Conventionally, a vacuum cleaner comprises, as shown in FIG. 1 which is a perspective view representing a general type vacuum cleaner, a main body 1 having a chamber for collecting dirt, a suction nozzle 4 for sucking air containing dirt therethrough, a flexible hose 2 connected to a connector of the main body 1, a handle or a pipe 3 connected to a connector of the suction nozzle 4, said hose 2 and said pipe 3 connected to each other and adapted for guiding the dirt, having sucked by the nozzle 4 from the surface being cleaned such as a carpet or the like, to the main body 1.

As shown in FIG. 2 which is an exploded perspective view representing the structure of the nozzle of the vacuum cleaner in accordance with the prior art, the suction nozzle 4 generally comprises a base 5, and a rotatable beater brush structure 6 rotatably mounted to the base 5 and adapted for agitating the surface being cleaned, such as a carpet or the like, for improved removal of dirt therefrom. A drive motor 8 is mounted on the base 5 at a back position spaced apart from the beater brush structure 6 for generating power for driving the beater brush structure 6, and a cog belt or timing belt 7 is disposed between the beater brush structure 6 to the drive motor 8 in order to connect them with each other so that the driving power is transmitted from the drive motor 8 to the beater brush structure 6.

The suction nozzle 4 is also provided with an air guider 9 for guiding the air including dirt having sucked by the nozzle 4, a spring 10 for controlling the height, a connector 11 rotatably mounted to the air guider 9 in order to be connected to a free end of the pipe 3 so that the air containing dirt having sucked by the nozzle 4 is guided to the pipe 3 thereby. A bumper 12 and an electric switch 13 are provided to the nozzle 4 for absorbing the outside shock and for switching the electric power for driving the drive motor 8, respectively. There is provided in the suction nozzle 4 an upper casing 14 mounted onto the base 5 in order to cover the enclosures enclosed in the casing provided by the upper casing 5 and the base 14, a switching button 15 connected to the switch 13 and adapted to be pushed by the operator for turning on switch 13, a cover 16 for covering the upper casing 14, and an electric cord 17 for supplying electric power from the outside power source to the drive motor 8 by way of the switch 13.

Among the above elements of the nozzle 4, the rotating beater brush 6 which is related to the present invention is generally provided with a helical brush strip having a plurality of brush elements or brush bundles and a helical beater strip having a plurality of rigid beater projections, both strips adapted for agitating the surface being cleaned such as a carpet, for improved removal of dirt therefrom.

A representative example of such a beater brush structure combined with a nozzle of vacuum cleaner is that disclosed in U.S. Pat. No. 4,429,430 of John B. Lyman which is referred to this invention in conjunction with the drawings, FIGS. 2 to 4.

As shown in the above-referenced drawings, the rotatable beater brush 6 is provided with a rotatable cylindrical dowel or roller 20. The roller 20 carries a plurality of helical undercut channels 21 and 21' formed on the circumferential surface thereof in order to each receive a brush strip 23 and a beater strip 24 therein. The brush strip 23 has a plurality of brush bundles 22 secured thereto and spaced apart from each other for agitating the surface being cleaned on rotation of the beater brush 6. Also, the beater strip 24 comprises a plurality of relatively rigid projections 25 which become engaged with the surface being cleaned on rotation of the beater brush 6. The undercut channels 21 and 21', the brush strip 23 and the beater strip 24, both strips 23 and 24 received in said undercut channels 21 and 21', are provided with complementary cross sections for retention of the strips 23 and 24 in the channels 21 and 21' against centrifugal forces developed in rotation of the roller 20 about the axis thereof, respectively.

Also, the beater brush roller 20 is generally manufactured of relatively high strength maple, a kind of gingko, and provided with a pair of rotating axles 27 and 27' inserted into fitting holes 26 and 26' provided at opposite ends thereof in order to project therefrom and support the rotation thereof. Each of the rotating axles 27 and 27' is provided with a knurled machined portion 27*a*, 27'*a* at a center thereof, respectively, so that the axles 27 and 27' are fixed to the roller 20 and prevented from moving with respect to the roller 20 by virtue of the knurled machined portions 27*a* and 27'*a* fitted into the fitting holes 26 and 26' of the opposite ends of the roller 20.

Also, the beater brush 6 comprises bearing mounts 30 and 30' each provided with an annular outturned string guard flange shoulder 31, 31' formed inwards from the circumferential periphery of a disc, a pair of radially projecting tabs 32,32' integrally formed on the opposite portions of the outer surface of the flange shoulders 31, 31' for holding the bearing mounts 30, 30' in place, and bearing housing portions 33, 33' inwardly provided at a center thereof. Each of the bearing mount 30, 30' has an oil-filled bronze sleeve bearing 40, 40' mounted into the bearing housing portion 33, 33' and slightly projecting from the front end of the housing portion 33, 33'.

Disposed between one bearing mount 30' and one end of the beater brush roller 20 is a support pulley 50.

On the other hand, a sprocket 60 and an edge brush assembly 80 are provided to the beater brush 6 as disposed between the other end of the roller 20 and the other bearing mount 30.

The sprocket 60 comprises a gear pulley 60' and a ring flange 70. the gear pulley 60' is provided with a first belt retainer flange 61 at a side circumferential surface thereof, a toothed array 62 formed on the circumferential surface thereof near the first flange 61 and adapted to be driven by the timing belt 7. The ring flange 70 is disposed between the other end of the roller 20 and the gear pulley 60', and provided with a second belt retainer flange 71 integrally outwardly formed with the circumferential surface thereof. Also, the gear pulley 60' has a reduced diamether cylindrical end 63 for receiving the ring flange 70 thereon in order to dispose the ring flange 70 at the axially opposite side of the toothed array 62 so as to cooperate with the toothed array. A pair of openings 64 are axially formed in the gear pulley 60' at opposite positions on the basis of the center opening thereof in order to engage with a pair of set screws 90 which are engaged with a pair of openings 28 formed on the other end of the roller 20.

The edge brush assembly 80 is provided outboard of the sprocket 60 and, as shown in FIG. 3, includes carrier provided with a plurality of brush tufts 82 and an integral beater bar 81. The assembly 81 is provided with a reduced diameter end portion 83 having double steps and adapted to be coaxially received within the gear pulley 60' of the sprocket 60. A pair of openings 84 are axially formed throughout the length of the edge brush assembly 80 for receiving the set screws 90. The set screws 90 engage with the openings 64 and 84 of the gear pulley 60' and the edge brush assembly 80, respectively, thereby accomplishing the abutting of the ring flange 70, the gear pulley 60' and the edge brush assembly 80 to the other end of the roller 20.

In accordance, the above beater brush 6 rotates by means of the drive power transmitted from the drive motor 8 to the toothed array 62 of the gear pulley 60' by way of the timing belt 7, thereby allowing the brush bundles 22 of the brush strip 23 and the rigid beater projections 25 of the beater strip 24 provided on the circumferential of the roller 20 to agitate the surface being cleaned, such as a carpet or the like, for improved removal of dirt therefrom.

Also, rotation of the edge brush assembly 80 accompanies the rotation of the roller 20 so that the brush tufts 82 and the integral beater bar 81 provided on the circumferential surface of the assembly 80 efficiently agitate the edge of the surface being cleaned, for improved removal of dirt.

However, the beater brush 6 has disadvantages in that it comprises the bearing mounts 30 and 30' at opposite ends thereof, which bearing mounts 30 and 30' are provided with the bearing housing portions 33 and 33' each including the oil-filled sleeve bearing 40, 40' projecting from the front end of the bearing housing portions 33, 33', and also the beater brush roller 20 rotates at relatively high speeds of about 5000–7000 rpm, so that an an overheat occurs at the coupling portions of the bearing housing portions 33 and 33' of the bearing mounts 30 and 30' at which the axles 27 and 27', mounted to opposite ends of the beater brush roller 20, engage with the oil-filled sleeve bearings 40 and 40' of the bearing housing portions 33 and 33'. In result, the oil filled in the sleeve bearings 40 and 40' becomes overheated, resulting in lowering the viscosity thereof, thereby causing the overheated oil to flow toward the outside through the sleeve bearings 40 and 40'. Therefore, the sleeve bearings 40 and 40' loses the oil therefrom, resulting in a failure to support the rotation of the axles 27 and 27' of the beater brush roller 20, thereby causing the using life of the beater brush 6 to be shortened. Furthermore, the beater brush 6 has no auxiliary structure for flowing the cooling air near the connecting portions of the bearing housing portions 33 and 33' so that the above disadvantage of overheating becomes aggravated.

Also, the beater brush 6 has another disadvantage in that it has gaps C between the support end 50 and the flange shoulder 31' of the bearing mount 30' and also between the edge brush assembly 80 and the flange shoulder 31 of the bearing mount 30, respectively, so that dirt easily enters the rotating portions of the axles 27 and 27' through the gaps C, resulting in disturbing the smooth rotation of the axles 27 and 27'. Also, the axles 27 and 27', each inserted into the opposite ends of the beater brush roller 20, often deviates from the concentricity with the roller 20 during the rotation thereof, thereby causing noise and vibration to occur from the beater brush 6 due to interference thereof with the other parts of the nozzle 4.

SUMMARY OF THE INVENTION

It is, therefore, an object of the present invention to provide a vacuum cleaner beater brush structure in which the above disadvantages can be overcome and in which the oil filled in the sleeve bearings can be prevented from being lost due to outflow when it is overheated due to the high speed rotation of the beater brush roller, thereby preventing damages to the rotating portions of the beater brush structure and causing the using life of said structure to be lengthened.

It is another object of the present invention to provide a vacuum cleaner beater brush structure in which the overheated air generated near the rotating portions thereof is efficiently exhausted outwards, thereby preventing damage to the parts of the structure due to the overheat.

It is still another object of the present invention to provide a vacuum cleaner beater brush structure in which dirt can be prevented from flowing in the rotating portions of the structure, thereby preventing damage to the rotating portions due to the dirt.

It is still another object of the present invention to provide a vacuum cleaner beater brush structure in which the axles can be accurately disposed at the opposite ends of the beater brush roller in order to secure the concentricity thereof with the roller, thereby preventing noise and vibration due to deviation of the concentricity.

The above mentioned objects of the present invention can be accomplished by providing a vacuum cleaner beater brush structure comprising: a beater brush roller provided with a helical brush strip and a beater strip, said brush strip having a plurality of brush bundles and said beater strip having a plurality of rigid projections; a sprocket comprising: a support flange coupled with an end of said beater brush roller, said support flange provided with a first belt retainer flange; and a gear pulley coupled with said support flange, said gear pulley comprising: a carrier having brush tufts and beater bars provided on circumferential surface thereof, respectively, and spaced from each other; a step formed as reducing a diameter of said carrier, said step adapted for forming a second belt retainer flange cooperating with said first belt retainer flange for retaining a power transmission belt; a toothed array formed on a circumferential surface of reduced diameter portion of said carrier, said array adapted for engaging with said belt; a circular rib formed axially outwards from circumferential periphery of said carrier, said rib adapted for preventing inflow of air containing dirt toward rotating portion of said beater brush structure; and an axle for supporting rotation of said beater brush structure, said axle integrally formed with a boss provided at a center opening of said gear pulley; a support end coupled with the other end of said beater brush roller, said support end comprising: a circular rib formed axially outwards from circumferential periphery thereof, said rib adapted for preventing inflow of air containing dirt toward rotating portion of said beater brush structure; and an axle for supporting rotation of said beater brush structure, said axle integrally formed with a boss provided at a center opening of said support end; and a pair of bearing mounts coupled with said gear end and said support pulley and receiving said axles of said gear pulley and support end, respectively, for supporting rotation of said axles, each of said bearing mounts comprising: a supporter for supporting said bearing mount, said supporter having means for engaging with a supporting frame of a nozzle of the vacuum cleaner; a bearing housing portion projecting from a center of said supporter and having an oil-filled sleeve bearing adapted to rotatably support said axle; and means for allowing air to flow therethrough, said means formed throughout the thickness of said supporter.

BRIEF DESCRIPTION OF THE DRAWINGS

The above and other objects, features and other advantages of the present invention will be more clearly understood from the following detailed description taken in conjunction with the accompanying drawings, in which:

FIGS. 7A to 7D are side views representing the side structures of parts of the beater brush of FIGS. 5 and 6, in which:

FIG. 7A shows a bearing mount;

FIG. 7B shows a gear pulley of a sprocket;

FIG. 7C shows a support flange of the sprocket; and

FIG. 7D shows a beater brush roller.

DETAILED DESCRIPTION OF THE PREFERRED EMBODIMENTS

Figure 5:
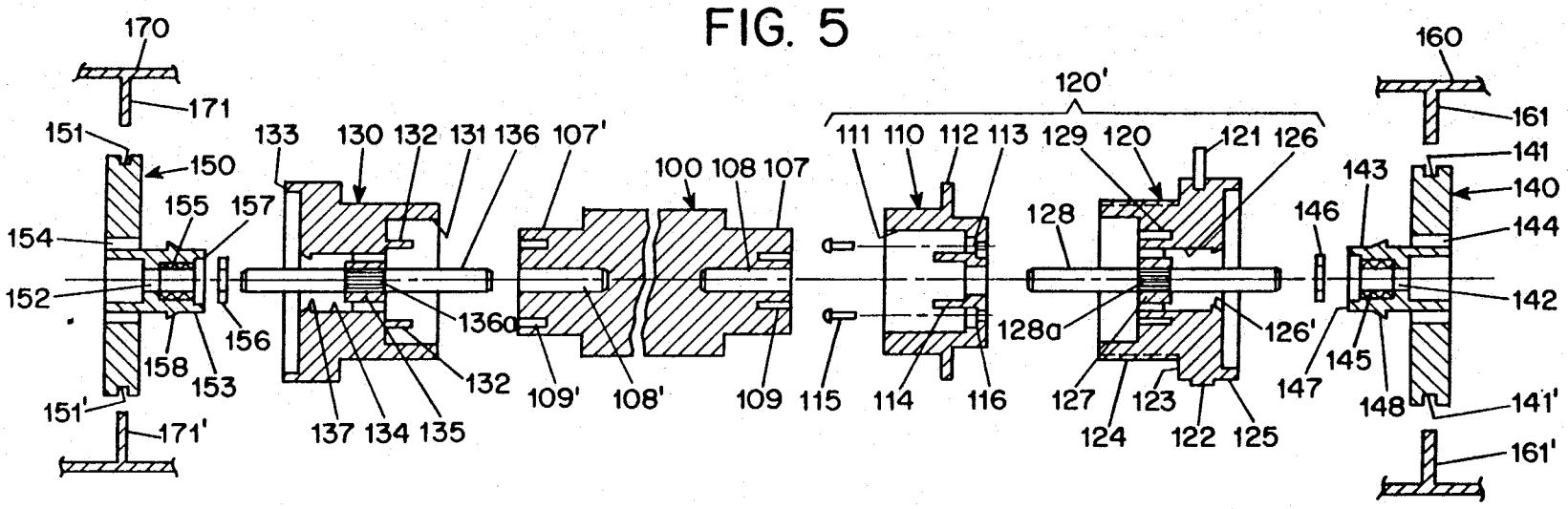
FIG. 5 is a view corresponding to FIG. 3, but showing the present invention.
Figure 6:
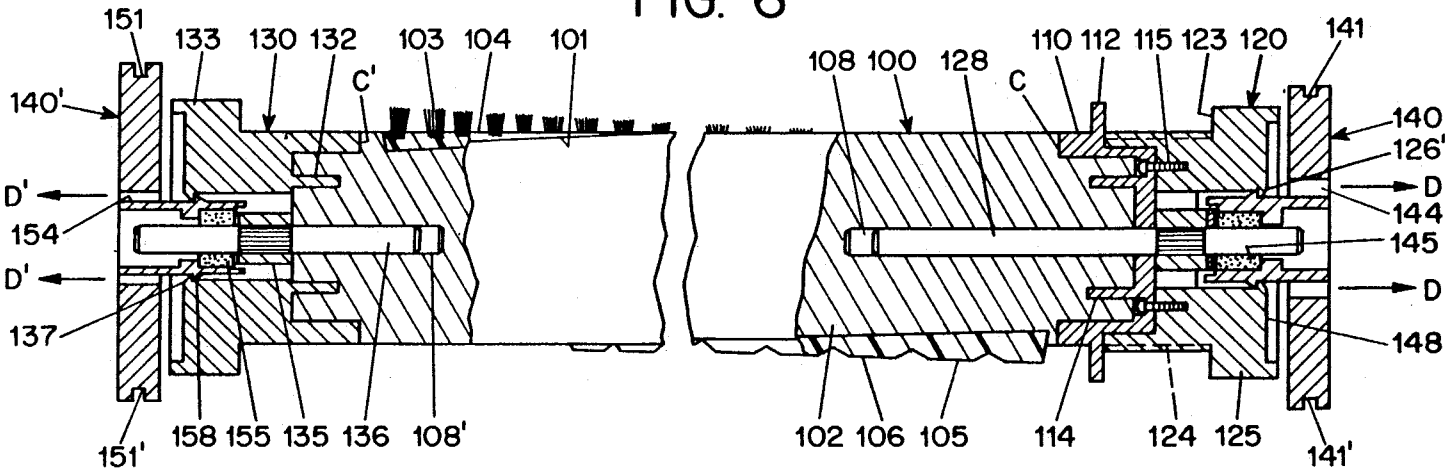
FIG. 6 is a view corresponding to FIG. 4, but showing the present invention.

Referring now to FIGS. 5 and 6 in which FIG. 5 is an exploded perspective view representing the structure of a beater brush of the nozzle in accordance with the present invention, and FIG. 6 is a longitudinal sectioned view of fully assembled the beater brush, the beater brush structure comprises a rotatably cylindrical dowel or a beater brush roller 100, a sprocket 120' having a support flange 110 coupling with an end of the roller 100 and a gear pulley 120 coupled with said support flange 110, a support end 130 coupled with the other end of the roller 100, and a pair of bearing mounts 140 and 150 each coupled with the support end 130 and the gear pulley 120, respectively.

The beater brush roller 100 is, as shown in FIG. 6, carries a plurality of helical undercut channels 101 and 102, formed on the circumferential surface thereof, each for receiving a helical brush strip 104 or a helical beater strip 106 therein. The brush strip 104 has a plurality of brush elements or bundles 103 secured thereto and spaced apart from each other for agitaing the surface being cleaned such as a carpet on rotation of the beater brush. Also, the beater strip 106 has a plurality of relatively rigid projections 105 which are engaged with the surface being cleaned on rotation of the beater brush. The undercut channels 101 and 102, the brush strip 104 and the beater strip 106, both strips 104 and 106 received in said undercut channels 101 and 102, are provided with complementary cross sections for retention of the strips 104 and 106 in the channels 101 and 102 against centrifugal forces developed in rotation of the roller 100 about the axis thereof.

Figure 1:
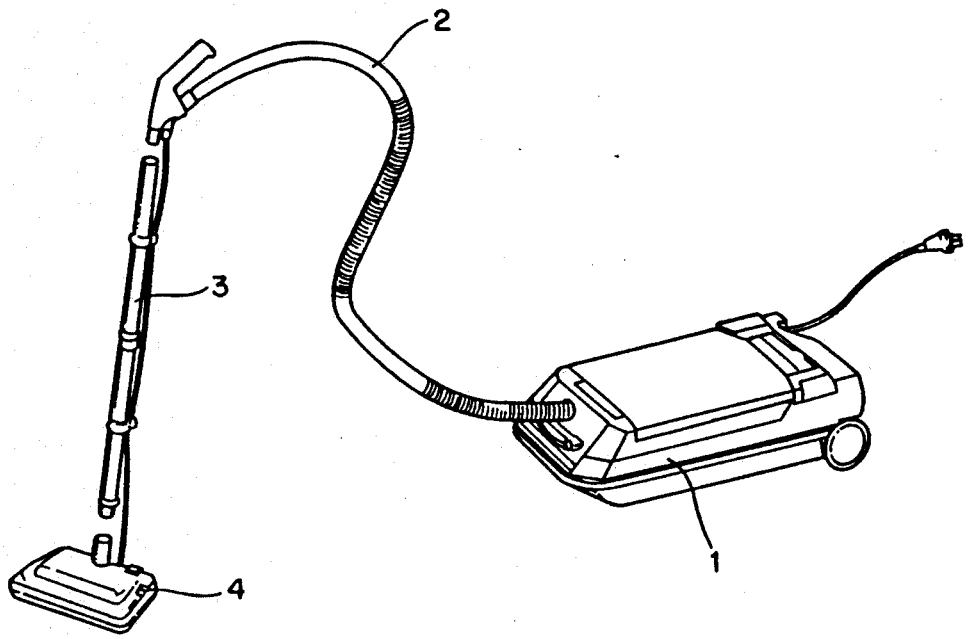
FIG. 1 PRIOR ART
FIG. 1 is a perspective view representing a general type vacuum cleaner.
Figure 7A:
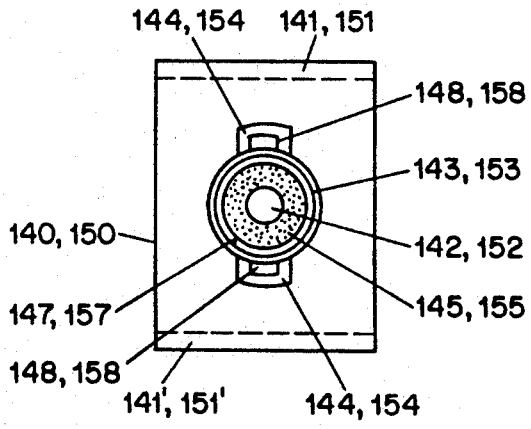
Figure 7B:
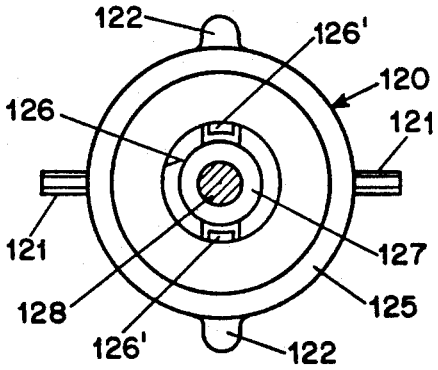

Also, the roller 100 has a pair of reduced diameter ends 107 and 107' formed at opposite ends thereof and having a width, and a pair of center axial holes 108 and 108' provided on the opposite ends of the roller 100 and machined by means of drilling and reaming. A plurality of small coupling holes 109 are formed at each end of the roller 100 around the center axial holes 108, 108' and spaced apart from each other. (in this embodiment, a pair of holes 109 are formed at opposite ends near the center axial holes 108, 108' as shown in FIG. 7D)

The support flange 110, a part of the sprocket 120', is provided with a cylindrical recess 111 of which inner diameter and depth are equal to the outer diameter and the width of the reduced diameter end 107 of the roller 100, respectively, so that the end 107 of the roller 100 fits into the recess 111 of the flange 110. A first belt retaining flange 112 is formed radially outwardly from the outer surface of the support flange 110 in order to retain a side of the timing belt 7 (see FIG. 2), and a center axial opening is provided at a center of bottom wall for defining an axial opening 113 for receiving an axle 128 which is integrally formed with the gear pulley 120.

Figure 7C:
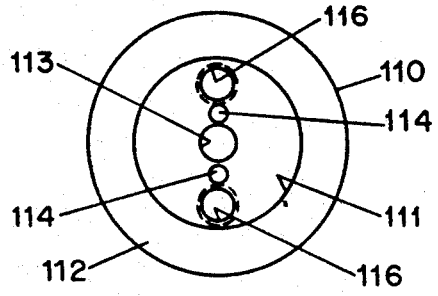
Figure 7D:
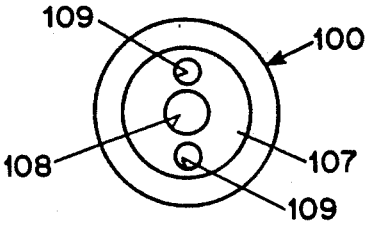

Also, the support flange 110 has, as shown in FIG. 7C, are provided with a pair of coupling projections 114 inwardly projecting from the inner surface of the bottom wall at opposite ends of the axial opening 113, and corresponding to the positions of the coupling holes 109 of the roller 100, so that the projections 114 are fitted into the holes 109 during the coupling of the roller 100 with the support flange 110. Formed at opposite positions of the bottom surface of the support flange 110 on the base of the axial opening 113 and out of the coupling projections 114 are a pair of small screw openings 116 for receiving a pair of set screws 115 for engaging the support flange 110 with the gear pulley 120 in order to accomplish the sprocket 120'. Also, the support flange 110 is provided with a reduced diameter end to be coupled with the gear pulley 120.

On the other hand, the gear pulley 120, which is a pair of the sprocket 120', comprises a carrier which carries a pair of brush tufts 121 and a pair of beater bars 122 each alternately disposed on the circumferential surface thereof at every 90° as shown in FIG. 7B. the pulley 120 is provided with reduced diameter step formed on the carrier, said step adapted for forming a second belt retainer flange for retaining the other side of the timing belt 7. Thus, the step cooperates with said first belt retainer flange 112 of the support flange 110 for retaining the timing belt 7. Also, there is provided a toothed array 124 formed on a circumferential surface of reduced diameter portion of said carrier of the gear pulley 120, the toothed array 124 is adapted for engaging with the timing belt 7. Extending outwardly from the circumferential periphery of said carrier of the gear pulley 120 is a circular rib 125 for preventing inflow of dirt toward the rotating portion of the beater brush, which is the coupling portion of the rotating axle 128 which is coupled with a support bearing of the bearing mount 140.

The gear pulley 120 also includes a center axial opening 126 integrally provided with a fixing boss 127. The boss 127 is provided with the axle 128 for supporting rotation of the beater brush, the axle 128 is provided with a knurled machined portion 128*a* at a center portion thereof wherein the axle 128 is integrally formed with the boss 127 by means of an insert injection molding so that the axle 128 concentrically projects from opposite ends of the boss 127. A pair of wedge type projections 126' are provided which project inwardly from the diametrical opposite positions of the inner surface of the axial opening 126 of the gear pulley 120. An enlarged inner diameter recess is formed at an opposite end of the gear pulley 120 and opposite to the circular rib 125 in order to receive the reduced diameter end of the support flange 110 for accomplishing assembling of the sprocket 120'.

There is provided a pair of inner threaded holes 129 formed at diametrical opposite positions of the bottom surface of the enlarged inner diameter (recess) of the gear pulley 120. The holes 129 engage with the set screws 115 which are inserted into the small screw openings 116 of the support flange 110, respectively, thereby accomplishing the combination of the sprocket 120'.

Figure 2:
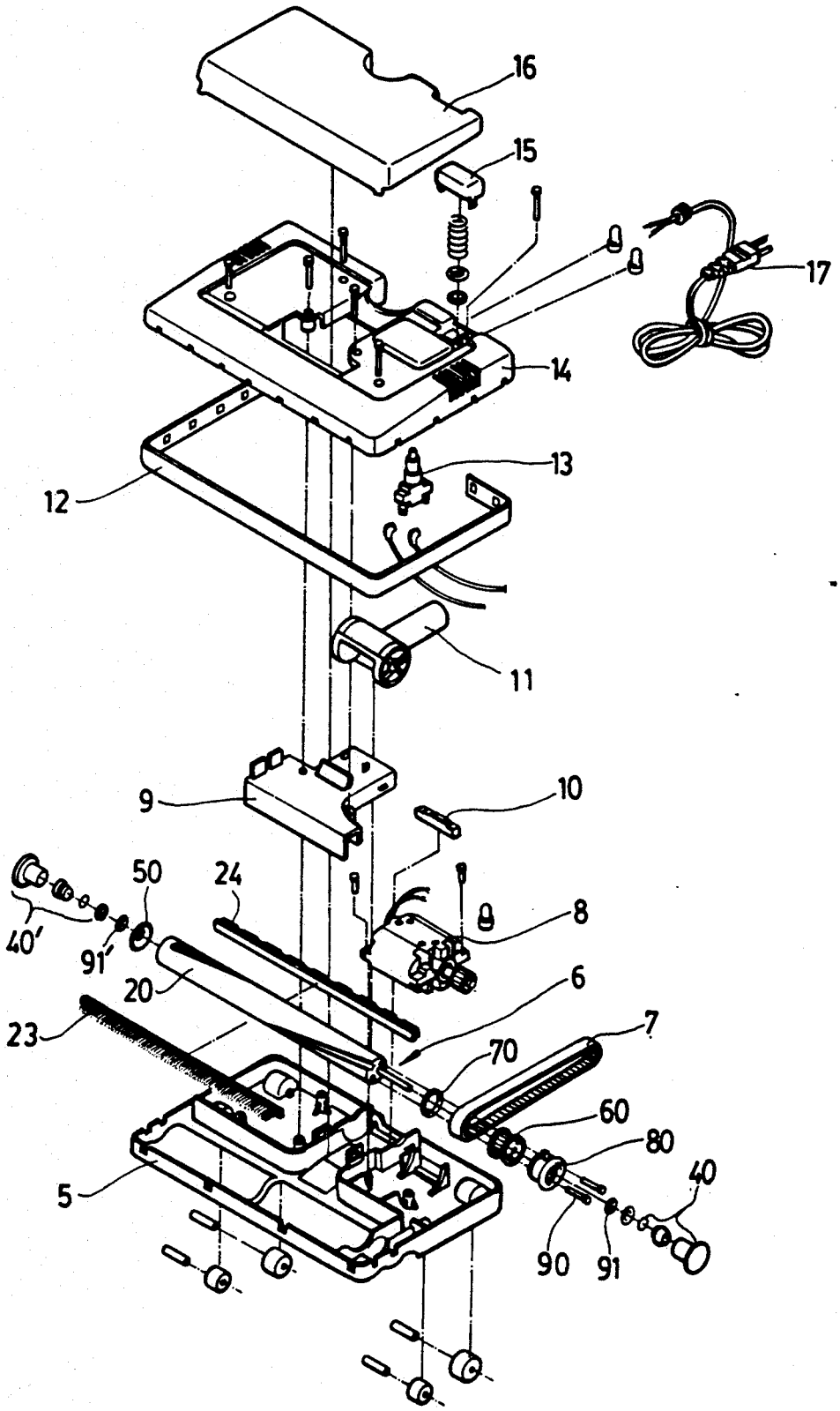
FIG. 2 PRIOR ART
FIG. 2 is an exploded perspective view representing the structure of a nozzle of a vacuum cleaner in accordance with the prior art.
Figure 3:
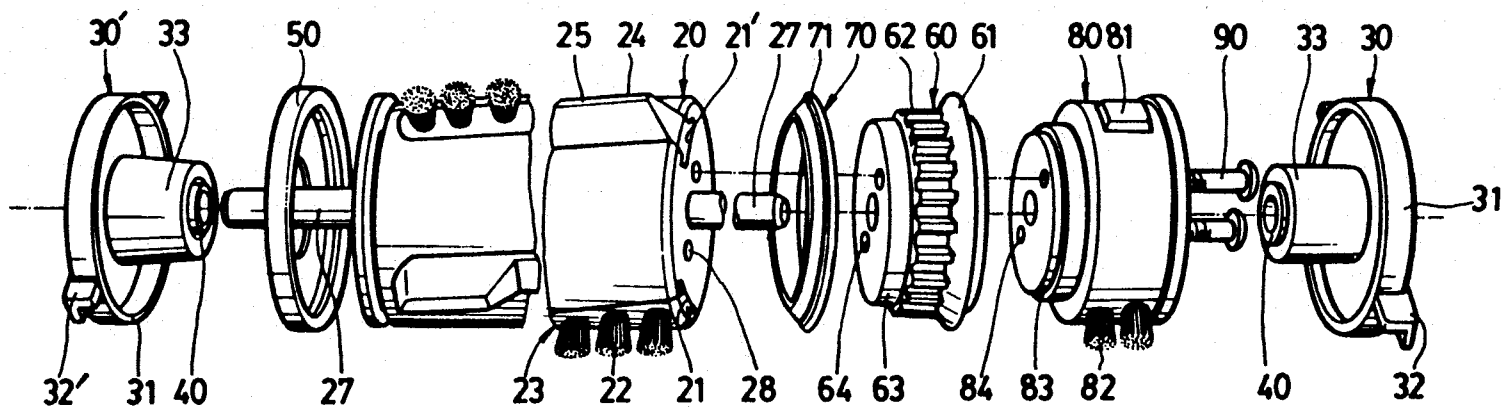
FIG. 3 PRIOR ART
FIG. 3 is an exploded perspective view representing the structure of a beater brush of the nozzle of FIG. 2.
Figure 4:
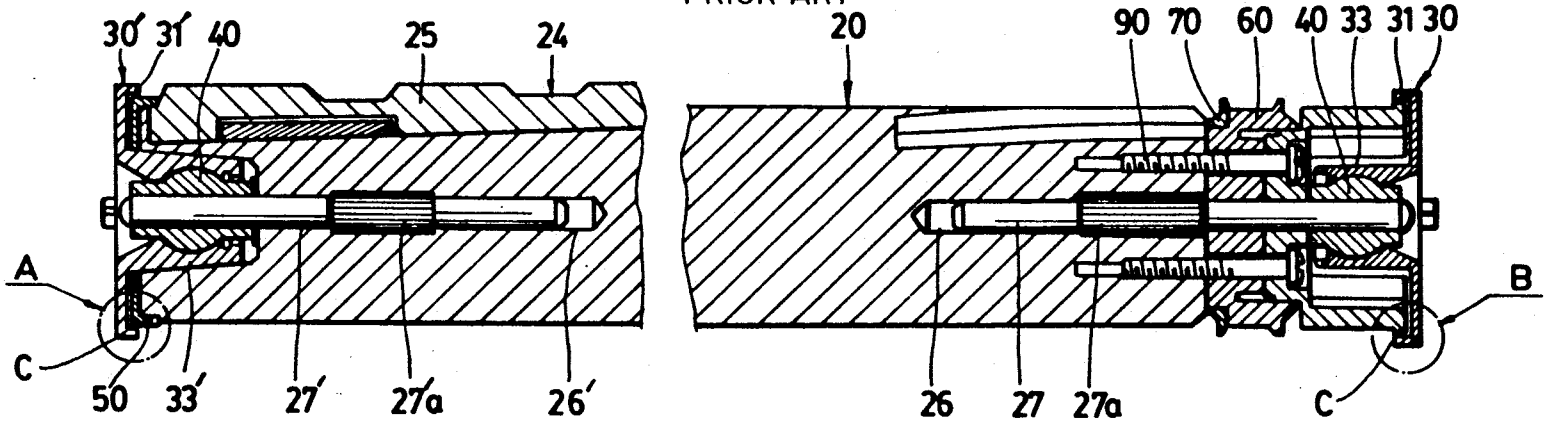
FIG. 4 PRIOR ART
FIG. 4 is a longitudinal sectioned view representing the structure of the beater brush of FIG. 3, after assembling.

On the other hand, the support end 130 is, as shown in FIG. 2, provided with a cylindrical recess 131 of which inner diameter and the depth are equal to the outer diameter and the width of the other reduced diameter end 107' of the roller 100, respectively, so that the end 107' of the roller 100 fits into the recess 131 of the support end 130.

Extending outwardly from the circumferential periphery of the support end 130 is a circular rib 133 for preventing inflow of dirt toward the rotating portion of the beater brush, which is the portion of the rotating axle 136 which is coupled with a support bearing of the bearing mount 150. Also, the support end 130 includes a center axial opening 134 integrally provided with a fixing boss 135. The boss 135 includes an axle 136 for supporting rotation of the beater brush at the other end thereof, the axle 136 is provided with a knurled machined portion 136*a* at a center portion thereof and integrally formed with the boss 135 by means of the same manner as the axle 128 of the gear pulley 120, which is the insert injection molding, thereby causing the axle 136 to concentrically project from opposite ends of the boss 135.

Projecting from the bottom surface of the bottom wall of the support end 130 at opposite positions of the axial opening 134 is a pair of coupling projections 132, the projections 132 correspond to the coupling holes 109' of the roller 100 so that the projections 114 are inserted into the hole 109' during the coupling of the roller 100 with the support flange 110. A pair of wedge type projections 137 are provided which project inwardly from the diametrical opposite positions of the inner surface of the axial opening 134 of the support pulley 130, in the same manner as those of the gear pulley 120.

On the other hand, the bearing mounts 140 and 150 couple with the gear pulley 120 and the support end 130 and receive the axles 128 and 136 of said pulley 120 and support end 130, respectively, for supporting the rotation of the axles 128 and 136. Each bearing mount 140, 150 comprises a base or a supporter having the rectangular shape as shown in FIG. 7*a*. Formed narrowly and laterally at upper and lower ends of each supporter are upper and lower locking grooves 141, 151 and 141', 151'. The grooves 141, 151 and 141', 151' are provided for engaging with upper and lower projections 161, 171 and 161', 171' of a supporting frame 160 and 170 of a nozzle 4 of the vacuum cleaner, thereby supporting the bearing mounts 140 and 150 not to move with respect to the frame 160 and 170, resulting in supporting the beater brush structure.

Projecting axially inwardly from a center portion of the supporter of the bearing mounts 140, 150 are bearing housing portions 143, 153 provided with axial openings 142, 152, each of the opening 142, 152 which are enclosed by an oil-filled sleeve bearing 145, 155 for receiving the axle 128, 136 so as to support the rotation of said axle 128. A pair of axial openings 144 and 154 are formed at diametrical opposite positions of the supporter of the bearing mounts 140 and 150 on the basis of the axial openings 142 and 152 so that overheat generated from the rotating portions of the beater brush structure is exhausted outwards through the openings 142 and 152, resulting in facilitating the cooling of the overheated rotating portions.

Each bearing housing portion 143, 153 is provided with an enlarged inner diameter end 147, 157 formed at a front end thereof before the oil-filled sleeve bearing 145, 155. The enlarged inner diameter end 147, 157 receives a washer 146, 156 for retaining oil, which has flowed out of the bearing 145, 155, in the bearing housing portion 143, 153. Also, a pair of wedge type projections 148, 158 are provided which project outwardly from diametrical opposite positions of each circumferential outer surface of the bearing housing portions 143, 153 for snapping on the projections 126', 137 of the gear pulley 120 or the support pulley 130.

In assembling the above beater brush structure, the support flange 110 is arranged with respect to the gear pulley 120 so as to communicate the small screw openings 116 of the support flange 110 and the inner threaded holes 129, respectively, simultaneously with receiving the axle 128 of the gear pulley 120 into the center opening 113 of the support flange 110 and the reduced diameter end of the flange 110 in the enlarged inner diameter portion of the gear pulley 120. The set screws 115 are then inserted into the openings 116 and the holes 129, and tightened in order to tightly couple the support flange 110 and the gear pulley 120, resulting in accomplishing the combination of the sprocket 120'.

Thereafter, an adhesive is applied to the both reduced diameter ends 107 and 107' and the contact surfaces C and C' of the support flange 110 and the support pulley 130, then the roller 100 is coupled at opposite ends 107 and 107' thereof to the support flange 110 and the support pulley 130 such that the coupling holes 109 and 109' of the roller 100 receive the coupling projections 114 and 132 of the support flange 110 and the support pulley 130, respectively.

The washers 146 and 156 are then inserted onto the axles 128 and 136, respectively. Thereafter, the axles 128 and 136 are forcibly inserted into the oil-filled sleeve bearings 145 and 155 of the bearing housing portions 143 and 153, respectively, until the outward projections 146 and 158 of the bearing housing portions 143 and 153 snap on the inward projections 126' and 137 of the pulley 120 and the support end 130, resulting in accomplishing the tight coupling of the gear pulley 120 and the support end 130 with the bearing mounts 140 and 150. The assembly of the beater brush structure is accomplished by engaging the upper and lower locking grooves 141, 151, 141' and 151' of the bearing mounts 140 and 150 with the upper and lower projections 161, 171, 161' and 171' of the supporting frame 160 and 170 of the nozzle 4 of the vacuum cleaner.

Thus, the bearing mounts 140 and 150 are supported by the supporting frames 160 and 170 of the nozzle 4 not to move with respect to the frames 160 and 170.

The beater brush structure, after assembling as described above, rotates by means of the drive power transmitted from the drive motor 8 to the toothed array 124 of the gear pulley 120 by way of the timing belt 7, thereby allowing the brush bundles 103 of the brush strip 104 and the rigid beater projections 105 of the beater strip 104 helically provided on the circumferential surface of the roller 100 to agitate the surface being cleaned, such as a carpet or the like, for improved removal of dirt therefrom. The following description is for describing the operational effect of the above beater brush structure.

The washers 146 and 156, closely disposed in the enlarged inner diameter ends 147 and 157 formed at respective front ends of the bearing housing portions 143 and 153 before the oil-filled sleeve bearing 145 and 155, fuction to retain the oil flowed out of the oil-filled sleeve bearings 145 and 155, even when the oil is flowed out of the sleeve bearings 145 and 155 due to lowering the viscosity thereof, resulting from the overheat generated at the engaging portions of the sleeve bearings 145 and 155 with the axles 128 and 136 during the high-speed rotation of the beater brush roller 100.

Thus, the beater brush structure provides an advantages in that a damage of rotating parts of the structure, which may occur due to loss of oil from the overheated sleeve bearings 145 and 155 thereof, is efficiently prevented by means of the enlarged inner diameter ends 147, 157 and the washers 146 and 156, each received in the end 147, 157 for retaining oil, flowed out of the bearings 145, 155, in the bearing housing portions 143, 153.

In addition, the beater brush structure is provided with the gear pulley 120 and the support end 130, both having the circular ribs 125 and 133 each extending outwardly from the circumferential periphery thereof for preventing inflow of dirt toward the rotating portion of the beater brush structure, which is the portion of the rotating axle 136 coupled with a support bearing of the bearing mount 150. Also, the bearing mounts 140 and 150 are provided with the axial openings 144 and 154 for exhausting air containing dirt, respectively. Thus, the air containing dirt can be exhausted outwards through the openings 144 and 154, such as represented at the arrows D and D' of FIG. 6, due to the rotational force of the structure even when the air containing dirt has flowed in the space between the pulleys 120 and 130 and the bearing mounts 140 and 150 from the roller 100 through gaps between the ribs 125 and 133 and the mounts 140 and 150 during the cleaning operation. Hence, the beater brush structure provides another advantage in that air containing dirt is forcedly exhausted so as to prevent from being deposited on the rotating portions thereof, resulting in improving the smooth rotation of the rotating portions. The exhausting of air through the openings 144 and 154 provides still another advantage of cooling the rotating portions of the structure by means of the flowing air.

Also, the axles 128 and 136 having knurled machined portions 128*a* and 136*a* are integrally formed with the gear pulley 120 and the support end 130 by insert injection molding, thereby accomplishing the accurate concentric arrangement of the axles 128 and 136 with the pulleys 120 and 130. Thus, the structure provides another advantage in that it secures the concentricity of the axles 128 and 136 with respect to the roller 100, thereby causing the noise and vibration of the structure to be reduced during operation, and improving the operational effect thereof.

As described above, the present invention provides a vacuum cleaner beater brush structure which provides advantages owing to improved functional effect in that the oil of the oil-filled sleeve bearing is prevented from loss by means of the washers and bearing housings which are engaged with said washers, and air containing dirt is outwardly exhausted through the openings of the bearing mounts, and also the axles are accurately disposed with respect to the structure by means of integral forming with the pulleys, thereby preventing a damage of the rotating parts thereof due to the overheat, improving smooth rotation of the rotating parts simultaneously. Further, the present invention accomplishes the cooling of said parts, and reducing the noise and vibration of the structure.

Although the preferred embodiments of the present invention have been disclosed for illustrative purpose, those skilled in the art will appreciate that various modifications, additions and substitutions are possible, without departing from the scope and spirt of the invention as disclosed in the accompanying claims.

What is claimed is:

1. A vacuum cleaner beater brush structure comprising:

a) a beater brush roller, the beater brush roller comprising:

1) a center portion and first and second end portions wherein the end portions are reduced in diameter;

2) a brush strip having a plurality of brush bundles, the brush strip provided on the center portion of said beater brush roller;

3) a beater strip having a plurality of rigid projections, the beater strip provided on said center portion of the beater brush roller; and 4) a pair of axle holes on each end portion of the beater brush roller;

b) a sprocket coupled to the second end portion of the beater brush roller, the sprocket comprising:

1) a support flange having a belt retainer flange, the support flange comprising:

a cylindrical recess for receiving a second end portion of the beater brush roller, an axial opening disposed opposite the cylindrical recess of the support flange and co-axial with the axle hole of the beater brush roller, and a pair of bolt openings positioned adjacent to the axial opening;

2) a gear pulley integrally molded with a first axle and coupled with the support flange, the gear pulley comprising:

a first cylindrical recess for receiving the support flange, a second cylindrical recess disposed opposite to the first cylindrical recess and having a pair of wedge-type snap projections positioned within the second cylindrical recess, an annular reduced-diameter step portion disposed around the first cylindrical recess and on an outer surface of the gear pulley wherein the annular step portion and the belt retainer flange couple to form a belt retainer portion for receiving a timing belt, a plurality of brushes and beater bars disposed on an outer surface of the gear pulley, and a ring-type anti-dust rib surrounding the second cylindrical recess and extending outwardly therefrom;

c) a support end molded integrally with a second axle and coupled to the first end portion of the beater brush roller, the support end comprising:

1) a third cylindrical recess for receiving the first end portion of said beater brush roller;

2) a fourth cylindrical recess disposed opposite to the third cylindrical recess and having a pair of wedge-type snap projections positioned within the fourth cylindrical recess;

3) a ring-type anti-dust rib surrounding the fourth cylindrical recess and extending outwardly therefrom; and d) a first bearing mount disposed opposite the second cylindrical recess and a second bearing mount disposed opposite the fourth cylindrical recess, each bearing mount comprising:

1) a cylindrical bearing housing having a washer and a oil-filled bearing wherein the washer prevents oil leakage;

2) a pair of wedge-type snap projections disposed on an outer circumferential surface of the cylindrical bearing housing;

3) an axial opening disposed throughout the cylindrical bearing housing for receiving the axle;

4) a plurality of ventilation openings disposed adjacent to the cylindrical housing for exhausting dust in the oil-filled bearing and for cooling the oil-filled bearing; and 5) a supporter having a top end and a bottom end for supporting the cylindrical bearing housing in a centered manner, the supporter having grooves disposed on the top end and the bottom end wherein the grooves are capable of engagement with a supporting frame of a vacuum cleaner head;

wherein the gear pulley being integrally molded with the first axle and the support end being integrally molded with the second axle are accurately engaged onto the beater brush roller and the first and second bearing mounts for efficiently and quietly rotating the beater brush roller during operation of the vacuum beater brush structure.

2. A vacuum cleaner beater brush structure as in claim 1, wherein said beater brush roller further comprises a plurality of axial holes disposed on the first and second end portions of the beater brush roller and wherein corresponding axial projections are provided within the cylindrical recess disposed on the support flange and within the third cylindrical recess disposed on the support end, such that the axial projections are adapted to be fitted into the corresponding axial holes for coupling the support flange and the support end to the beater brush roller.

3. A vacuum cleaner beater brush structure as in claim 1, wherein an adhesive is provided on the first and second end portions of the beater brush roller for adhering the beater brush roller to the support flange and to the support end.

* * * * *